US010522092B2

(12) United States Patent
Hsu et al.

(10) Patent No.: US 10,522,092 B2
(45) Date of Patent: Dec. 31, 2019

(54) ELECTRONIC PAPER DISPLAY APPARATUS AND DRIVING METHOD THEREOF

(71) Applicant: E Ink Holdings Inc., Hsinchu (TW)

(72) Inventors: Kuo-Han Hsu, Taoyuan (TW); Mu-Chen Tan, Taoyuan (TW); Ming-Hung Chen, Taoyuan (TW)

(73) Assignee: E Ink Holdings Inc., Hsinchu (TW)

( * ) Notice: Subject to any disclaimer, the term of this patent is extended or adjusted under 35 U.S.C. 154(b) by 114 days.

(21) Appl. No.: 15/394,822

(22) Filed: Dec. 30, 2016

(65) Prior Publication Data

US 2017/0193940 A1 Jul. 6, 2017

(30) Foreign Application Priority Data

Dec. 31, 2015 (TW) ..... 104144596 A

(51) Int. Cl.
*G09G 3/34* (2006.01)
*G09G 3/20* (2006.01)

(52) U.S. Cl.
CPC ..... *G09G 3/34* (2013.01); *G09G 3/2096* (2013.01)

(58) Field of Classification Search
CPC ..... G09G 3/2092; G09G 3/2096; G09G 3/3433–348; G09G 3/36; G09G 3/3611; G09G 3/3648; G09G 3/3696; G09G 5/003–008; G09G 2300/02; G09G 2300/0842; G09G 2300/0876; G09G 2310/0254; G09G 2310/0275; G09G 2310/06; G09G 2310/063; G09G 2310/068; G09G 2310/08; G09G 2320/0204; G09G 2360/02–08; G09G 2370/04; G09G 2370/08; G06F 1/1647–165; G06F 1/1654; G06F 1/26; G06F 1/32; G06F 1/3209; G06F 1/3215; G06F 1/3218
See application file for complete search history.

(56) References Cited

U.S. PATENT DOCUMENTS 8,310,439 B2 11/2012 Lee et al.
8,564,584 B2 10/2013 Huang et al.
8,629,879 B2 1/2014 Low et al.
8,823,722 B1 9/2014 Huang et al.
(Continued)

FOREIGN PATENT DOCUMENTS

CN 102034435 4/2011
CN 103676395 3/2014
(Continued)

OTHER PUBLICATIONS

"Office Action of China Counterpart Application," dated Aug. 7, 2018, pp. 1-8.

*Primary Examiner* — Nathan Danielsen
(74) *Attorney, Agent, or Firm* — JCIPRNET

(57) ABSTRACT

An electronic paper display apparatus and a driving method thereof are provided. The electronic paper display apparatus includes an electronic paper display panel and a control chip. The control chip is coupled to the electronic paper display panel. The control chip is configured to generate a clock signal and simulate a driving signal according to the clock signal and panel control data. The control chip drives the electronic paper display panel by utilizing the clock signal and the driving signal.

12 Claims, 4 Drawing Sheets

(56) References Cited

U.S. PATENT DOCUMENTS

| | | | | |
|---|---|---|---|---|
| 2001/0030649 | A1* | 10/2001 | Mamiya | G09G 5/006 345/530 |
| 2006/0056000 | A1* | 3/2006 | Mignard | G09G 3/3466 359/245 |
| 2009/0153470 | A1* | 6/2009 | Chen | G06F 1/1624 345/156 |
| 2011/0267297 | A1* | 11/2011 | Yamazaki | G06F 1/3265 345/173 |
| 2012/0013580 | A1 | 1/2012 | Lin et al. | |
| 2012/0188272 | A1 | 7/2012 | Wang | |
| 2014/0139500 | A1 | 5/2014 | Kimura et al. | |
| 2014/0240333 | A1 | 8/2014 | Shirota et al. | |
| 2016/0035313 | A1* | 2/2016 | Zhang | G09G 5/006 348/474 |

FOREIGN PATENT DOCUMENTS

| | | |
|---|---|---|
| CN | 103680416 | 3/2014 |
| TW | 201232505 | 8/2012 |

* cited by examiner

ELECTRONIC PAPER DISPLAY APPARATUS AND DRIVING METHOD THEREOF

CROSS-REFERENCE TO RELATED APPLICATION

This application claims the priority benefit of Taiwan application serial no. 104144596, filed on Dec. 31, 2015. The entirety of the above-mentioned patent application is hereby incorporated by reference herein and made a part of this specification.

BACKGROUND OF THE INVENTION

Field of the Invention

The invention relates to a display apparatus and a driving method thereof and more particularly relates to an electronic paper display apparatus and a driving method thereof.

Description of Related Art

To improve the quality of electronic paper display apparatus, how to drive the electronic paper display panel with a proper driving chip is an important issue that needs to be addressed. The conventional processor chip is unable to directly drive the electronic paper display panel and needs to be additionally coupled to a conversion chip integrated with timing control (TCON) in order to output the driving signal required by the electronic paper display panel. However, the SOCs (system on chip) that are currently available in the market are lack of such timing control chips that can directly drive the electronic paper display panel. For this reason, it is required to additionally design the conversion chip integrated with timing control for the electronic paper display panel, such that the outputted driving signal can conform to the interface of the electronic paper display panel. The additional design of the conversion chip integrated with timing control will raise the production cost of the electronic paper display apparatus. Moreover, the electronic paper display panel requires a stable clock signal. The conventional processor chip needs to process system operations from time to time, which may sometimes interfere with the sending of the clock signal and make it difficult to control the timing of the clock signal. In view of the above, several embodiments of the invention are provided as follows.

SUMMARY OF THE INVENTION

The invention provides an electronic paper display apparatus and a driving method of the electronic paper display apparatus for improving the display quality and reducing the complexity of circuit design.

An electronic paper display apparatus of the invention includes an electronic paper display panel and a control chip coupled to the electronic paper display panel to generate a clock signal. The control chip simulates a driving signal according to the clock signal and panel control data and drives the electronic paper display panel with the clock signal and the driving signal.

In an embodiment of the invention, the control chip includes a display controller and a data transmission interface. The display controller generates the clock signal and outputs the panel control data according to the clock signal. The data transmission interface is coupled to the display controller. The data transmission interface simulates the driving signal according to the panel control data to drive the electronic paper display panel.

In an embodiment of the invention, the display controller is a liquid crystal display (LCD) controller.

In an embodiment of the invention, the driving signal includes a control signal and control data.

In an embodiment of the invention, the electronic paper display apparatus further includes a signal conversion circuit coupled to the control chip and the electronic paper display panel. The signal conversion circuit receives the driving signal and converts the driving signal to a panel driving signal that conforms to a signal transmission interface of the electronic paper display panel to drive the electronic paper display panel.

In an embodiment of the invention, the electronic paper display apparatus further includes a system module coupled to the control chip to transmits the panel control data to the control chip.

In an embodiment of the invention, the system module further transmits an operation signal to the control chip. The control chip generates the control signal according to the operation signal.

In an embodiment of the invention, the electronic paper display apparatus further includes a storage module coupled to the control chip to store the panel control data.

In an embodiment of the invention, the control chip includes a processor coupled to the storage module and the system module. The processor receives the panel control data and stores the panel control data in the storage module.

In an embodiment of the invention, the control chip includes an access circuit coupled to the storage module to read the panel control data.

According to a driving method of an electronic paper display apparatus of the invention, an electronic paper display panel in the electronic paper display apparatus is driven by a control chip. The driving method includes: generating a clock signal; simulating a driving signal according to the clock signal and panel control data; and driving the electronic paper display panel with the clock signal and the driving signal.

In an embodiment of the invention, the control chip includes a display controller and a data transmission interface. The display controller generates the clock signal and simulates the driving signal by the data transmission interface according to the clock signal and the panel control data.

In an embodiment of the invention, the display controller is a liquid crystal display (LCD) controller.

In an embodiment of the invention, the driving signal includes a control signal and control data.

In an embodiment of the invention, the step of driving the electronic paper display panel with the clock signal and the driving signal further includes: converting the driving signal to a panel driving signal that conforms to a signal transmission interface of the electronic paper display panel by a signal conversion circuit to drive the electronic paper display panel.

In an embodiment of the invention, the driving method further includes: transmitting the panel control data to the control chip by a system module.

In an embodiment of the invention, the step of transmitting the panel control data to the control chip by the system module further includes: transmitting an operation signal to the control chip by the system module. The control chip generates the clock signal according to the operation signal.

In an embodiment of the invention, the driving method further includes: storing the panel control data by a storage module.

In an embodiment of the invention, the control chip includes a processor to receive the panel control data and store the panel control data in the storage module.

In an embodiment of the invention, the step of storing the panel control data by the storage module includes: receiving the panel control data and storing the panel control data in the storage module.

Based on the above, the control chip of the electronic paper display apparatus according to the embodiments of the invention simulates the driving signal according to the clock signal and the panel control data and drives the electronic paper display panel with the clock signal and the driving signal, so as to improve the display quality and reduce the complexity of the circuit design.

To make the aforementioned and other features and advantages of the invention more comprehensible, several embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate exemplary embodiments of the invention and, together with the description, serve to explain the principles of the invention.

DESCRIPTION OF THE EMBODIMENTS

Figure 1:
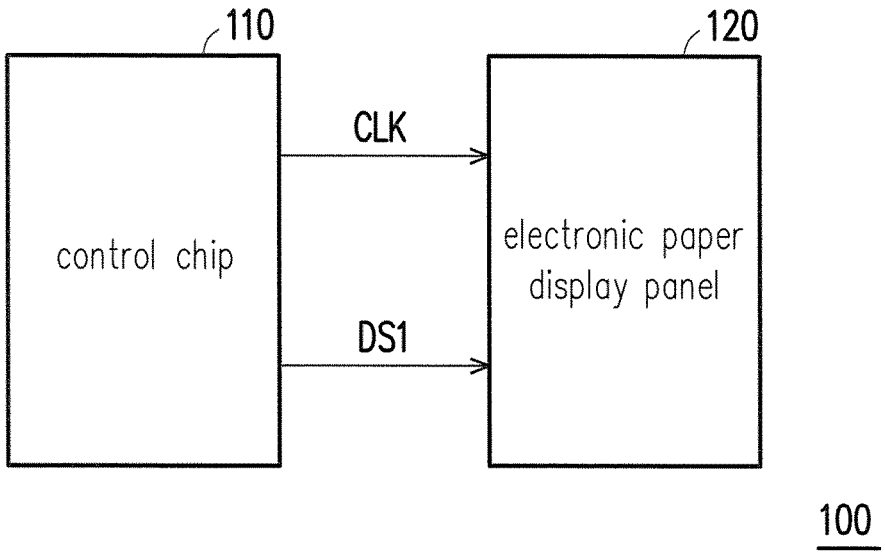
FIG. 1 is a schematic diagram of the electronic paper display apparatus according to an embodiment of the invention.

The term "couple" used throughout this specification (including the claims) may refer to any direct or indirect connection means. For example, if it is described that a control chip is coupled to an electronic paper display panel, it should be understood that the control chip may be directly connected to the electronic paper display panel or indirectly connected to the electronic paper display panel through other devices, wires, or certain connection means. Moreover, elements/components/steps with the same reference numerals represent the same or similar parts in the figures and embodiments where appropriate. Descriptions of elements/components/steps with the same reference numerals or terms in different embodiments may be reference for one another.

FIG. 1 is a schematic diagram of an electronic paper display apparatus according to all embodiment of the invention. Please refer to FIG. 1. In this embodiment, an electronic paper display apparatus 100 includes a control chip 110 and an electronic paper display panel 120. The control chip 110 is configured to generate a clock signal CLK and simulate a driving signal DS1 according to the clock signal CLK and panel control data. The control chip 110 is coupled to the electronic paper display panel 120. The control chip 110 drives the electronic paper display panel 120 with the clock signal CLK and the driving signal DS1. Specifically, in this embodiment, the control chip 110 is capable of generating the clock signal CLK stably and simulating the driving signal DS1 according to the generated clock signal CLK and the panel control data.

In this embodiment, the control chip 110 simulates the driving signal DS1 according to the clock signal CLK and the panel control data that is preset in the control chip 110. For example, the panel control data may include a plurality of pieces of digital information, and the control chip 110 combines the digital information according to the clock signal CLK and then simulates the driving signal DS1 that is to be directly outputted to the electronic paper display panel 120.

Figure 2:
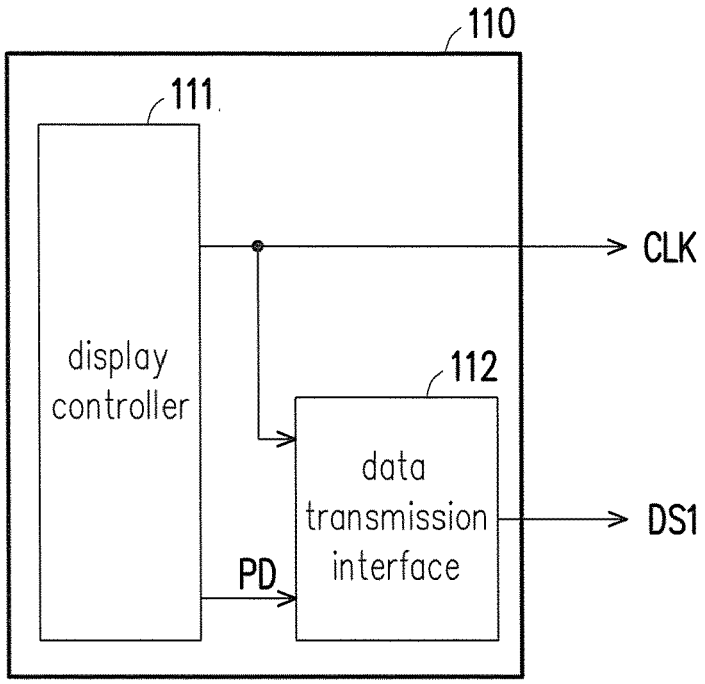
FIG. 2 is a schematic diagram of the control chip in the embodiment of FIG. 1.

Specifically, FIG. 2 is a schematic diagram of the control chip in the embodiment of FIG. 1. Please refer to FIG. 1 and FIG. 2. In this embodiment, the control chip 110 includes a display controller 111 and a data transmission interface 112. The display controller 111 is configured to output the clock signal CLK to the electronic paper display panel 120 and output panel control data PD to the data transmission interface 112 according to the clock signal CLK. The data transmission interface 112 simulates and outputs the driving signal DS1 with the panel control data PD. In this embodiment, the data transmission interface 112 may be a data port for receiving the panel control data PD outputted by the display controller 111 to simulate the driving signal DS1. The driving signal DS1 may serve as a panel driving signal to be directly inputted to the electronic paper display panel 120 for controlling the electronic paper display panel 120. For example, the panel control data PD may include information of a control signal and information of control data. Therefore, the panel control data PD outputted by the display controller 111 may be outputted through four or eight data pins by the data transmission interface 112 to simulate and output the driving signal DS1, which includes the control signal and the control data, required by the electronic paper display panel 120. For example, the driving signal DS1 including the control signal may be simulated and outputted by using four data pins, or the driving signal DS1 including the control data may be simulated and outputted by using eight data pins.

In this embodiment, the driving of the electronic paper display panel 120 requires a stable clock signal, and in order to prevent that the driving chip interferes with the timing of sending the clock signal when the driving chip executes other system works, in this embodiment, the control chip 110 may be a system on a chip (SOC) and at least provide a single chip IC for the driving function and operation function of a liquid crystal display panel. The display controller 111 is a liquid crystal display (LCD) controller capable of outputting the clock signal CLK stably and outputting the panel control data PD to the data transmission interface 112 according to the clock signal CLK. The data transmission interface 112 simulates the driving signal DS1 with the panel control data PD. The aforementioned display controller 111 may also be applied to other types of panels and a liquid crystal display. The aforementioned electronic paper display panel may also be a panel that adopts the same driving method as a conventional electronic paper display panel.

In other words, in this embodiment, the control chip 110 does not use the LCD driving function thereof but uses the driving signal DS1 simulated with the clock signal CLK and the panel control data PD to drive the electronic paper display panel 120. The driving signal DS1 may directly serve as the panel driving signal to drive the electronic paper display panel 120. Moreover, the timing that the processor sends the driving signal may be easily interfered with. In order to prevent the display quality from being affected by such interference, the invention does not drive the electronic paper display panel 120 with the driving signal, which the control chip 110 already has for driving liquid crystal. The aforementioned driving signal in the control chip 110 for driving liquid crystal may be a vertical sync signal (Vsync) and a horizontal sync signal (Hsync), for example.

Figure 3:
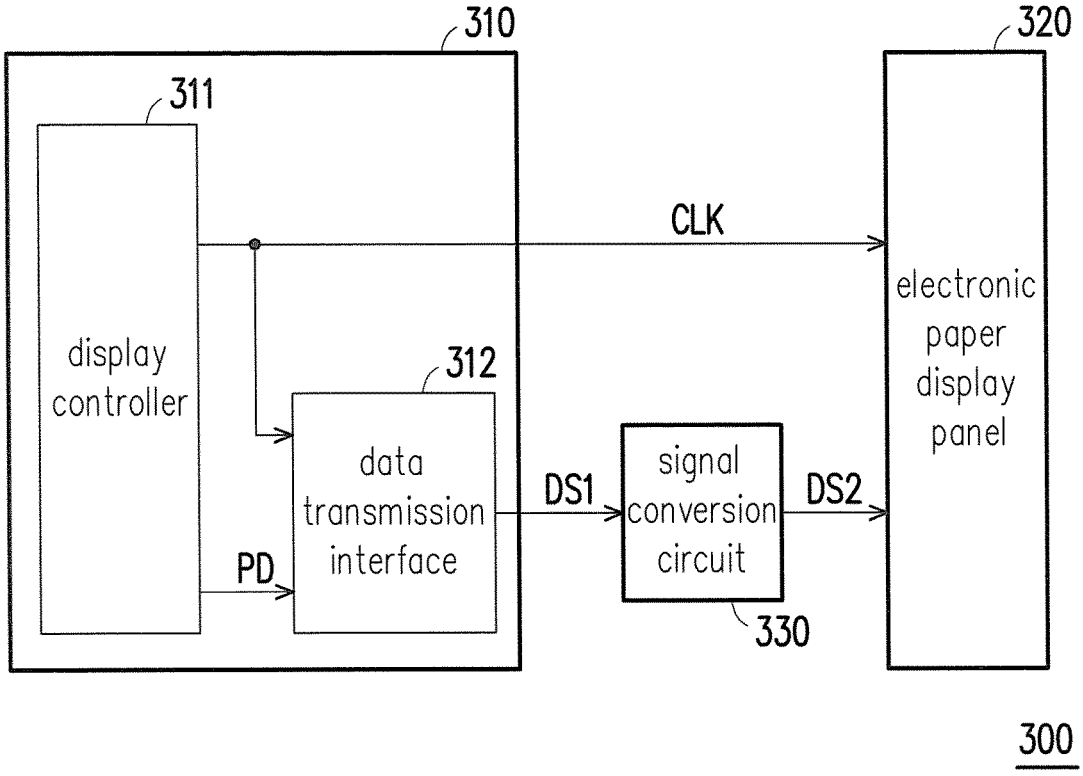
FIG. 3 is a schematic diagram of the electronic paper display apparatus according to another embodiment of the invention.

FIG. 3 is a schematic diagram of the electronic paper display apparatus according to another embodiment of the invention. Please refer to FIG. 3. In this embodiment, a control chip 310 includes a display controller 311 and a data transmission interface 312. The display controller 311 is configured to output a clock signal CLK to an electronic paper display panel 320 and output panel control data PD to a data transmission interface 312 according to the clock signal CLK. The data transmission interface 312 simulates and outputs a driving signal DS1 with the panel control data PD. It should be noted that, in this embodiment, the electronic paper display apparatus 300 further includes a signal conversion circuit 330. The signal conversion circuit 330 is configured to receive the driving signal DS1 outputted by the data transmission interface 312 and convert the driving signal DS1 to a driving signal DS2 that conforms to a signal transmission interface of the electronic paper display panel 320.

Specifically, in this embodiment, it is assumed that the driving signal simulated by the display controller 311 and the data transmission interface 312 for driving the liquid crystal display apparatus does not conform to the interface of the electronic paper display panel 320 and thus cannot be used directly for driving the electronic paper display panel 320. Therefore, in addition to simulating the driving signal with the clock signal CLK generated by the display controller 311 and the preset panel control data PD, the signal conversion circuit 330 is further disposed between the data transmission interface 312 and the electronic paper display panel 320. In other words, the signal conversion circuit 330 is capable of converting the driving signal DS1 simulated by the data transmission interface 312 by signal conversion to the panel driving signal DS2 that conforms to the signal transmission interface of the electronic paper display panel 320 for driving the electronic paper display panel 320.

Figure 4:
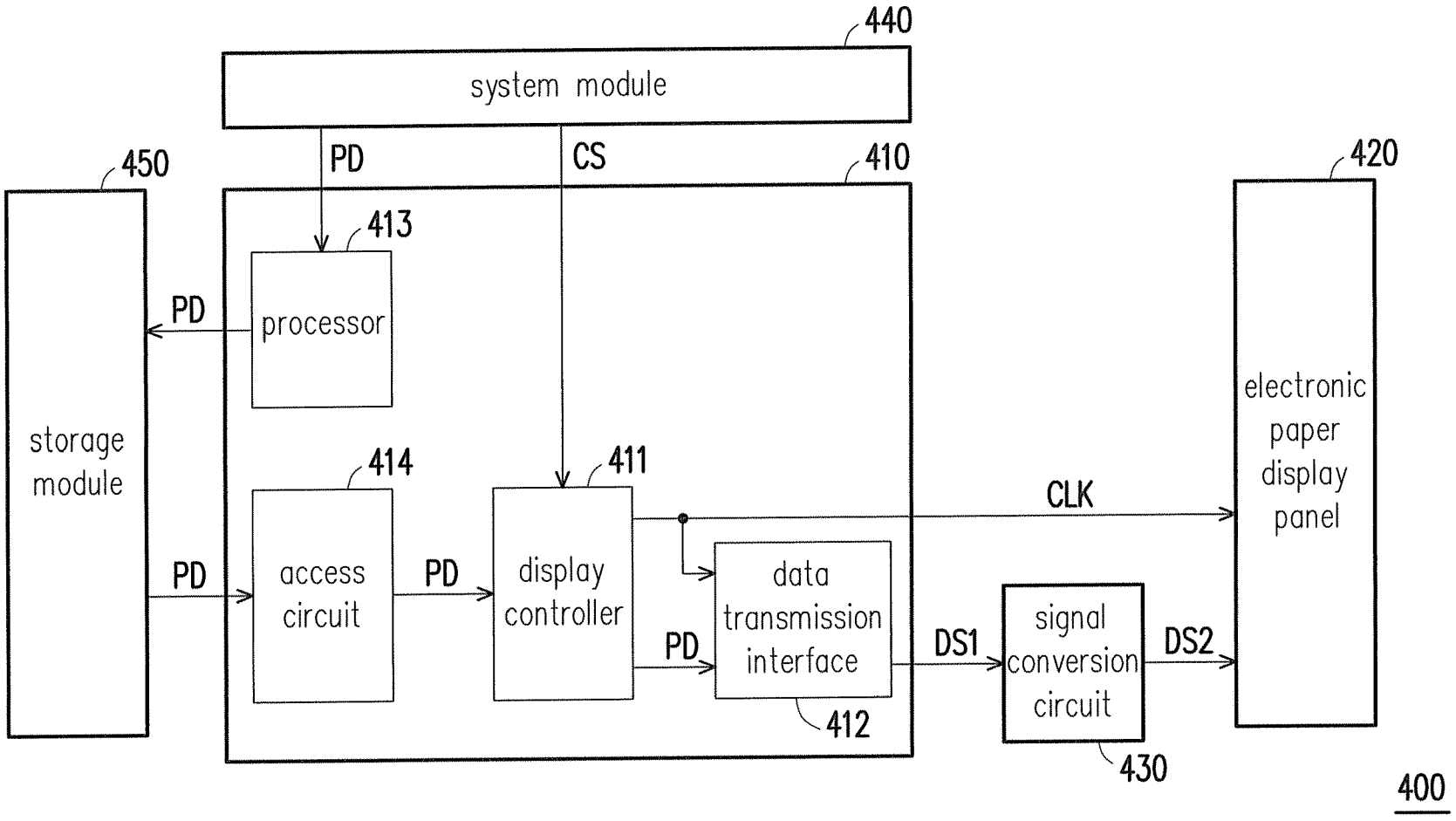
FIG. 4 is a schematic diagram of the electronic paper display apparatus according to another embodiment of the invention.

FIG. 4 is a schematic diagram of the electronic paper display apparatus according to another embodiment of the invention. Please refer to FIG. 4. In this embodiment, an electronic paper display apparatus 400 further includes a system module 440 and a storage module 450. A control chip 410 further includes a processor 413 and an access circuit 414. In this embodiment, the system module 440 is coupled to the processor 413 for inputting the panel control data PD to the processor 413. The processor 413 may store the received panel control data PD to the storage module 450. A display controller 411 may directly read the panel control data PD in the storage module 450 through the access circuit 414. Moreover, the system module 440 is further configured to input an operation signal CS to the display controller 411. The display controller 411 may determine the timing of the clock signal CLK according to a content of the operation signal CS.

Specifically, first, the system module 440 may output the operation signal CS to the display controller 411 according to a user's setting or external operation control to determine the timing of the clock signal CLK and may input the panel control data PD according to a requirement of use. Furthermore, the control chip 410 may receive the panel control data PD by the processor 413 and store the received panel control data PD in the storage module 450. Next, the control display controller 411 may read the panel control data PD stored in the storage module 450 according to the clock signal CLK through the access circuit 414. Then, the control display controller 411 outputs the panel control data PD to the data transmission interface 412 according to the clock signal CLK. At last, the driving signal DS1 is simulated and outputted according to the panel control data PD by the data transmission interface 412.

It should be noted that, in this embodiment, the electronic paper display apparatus 400 does not use the processor 413 to determine output of the driving signal. The processor 413 is configured only to receive and store the panel control data PD in the storage module 450. The electronic paper display apparatus 400 directly reads the panel control data PD in the storage module 450 by the display controller 411 and simulates the driving signal DS1 with the clock signal CLK set by the operation signal CS and the panel control data PD by using the data transmission interface 412.

It should also be noted that, in this embodiment, it is assumed that the driving signal DS1 may be directly used for driving the electronic paper display panel 420 without using the data transmission interface 412 to convert the driving signal DS1 to the driving signal DS2. The data transmission interface 412 may directly output to control the electronic paper display panel 420. However, provided that the driving signal DS1 cannot be directly used for driving the electronic paper display panel 420, the signal conversion circuit 430 is required between the data transmission interface 412 and the electronic paper display panel 420. The signal conversion circuit 430 is configured to convert the driving signal DS1 to the panel driving signal DS2 that conforms to the signal transmission interface of the electronic paper display panel 420.

In addition, in this embodiment, the system module 440 may be a system circuit that is combined with the control chip 410 in the electronic paper display apparatus 400. The system module 440 may be operated by the user and generate the operation signal CS, so as to set the clock signal CLK or the panel control data PD in the control chip 410. The invention is not intended to limit a method of operating the system circuit. In this embodiment, the processor 413 may be a central processing unit (CPU), a programmable microprocessor for general or special use, a digital signal processor (DSP), other similar devices, or a combination of the foregoing, for example. Nevertheless, the invention is not intended to limit the type of the processor 413. The storage module 450 and the access circuit 414 may be a memory module and a DMA (direct memory access) circuit respectively. The memory module may be a SRAM (static random access memory) or a DRAM (dynamic random access memory). Nevertheless, the invention is not intended to limit the type of the memory module.

Besides, in this embodiment, implementations, details of the devices, and configuration relationship of the control chip and the electronic paper display panel shown in FIG. 4 can be understood sufficiently from the teaching, suggestion, and illustration of the previous embodiments. Thus, details thereof are not repeated hereinafter.

Figure 5:
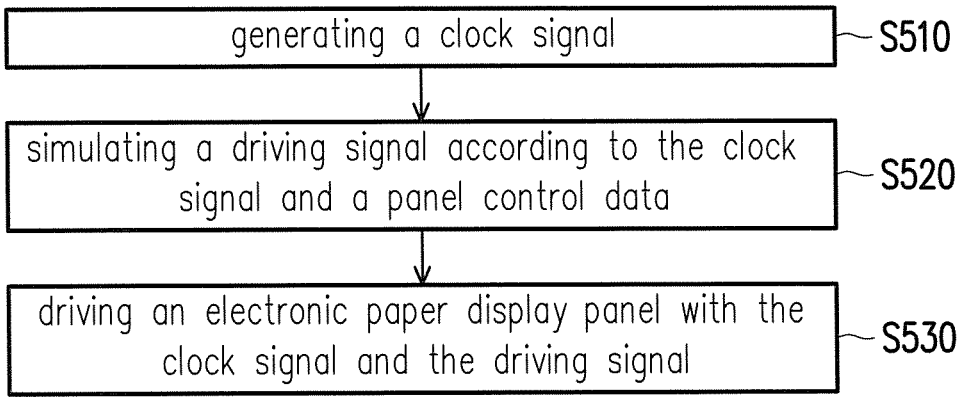
FIG. 5 is a flowchart showing the driving method of the electronic paper display apparatus according to an embodiment of the invention.

FIG. 5 is a flowchart showing a driving method of the electronic paper display apparatus according to an embodiment of the invention. Please refer to FIG. 1 and FIG. 5. The driving method of the electronic paper display apparatus of this embodiment is at least applicable to the electronic paper display apparatus 100 of FIG. 1. In Step S510, the control chip 110 generates the clock signal CLK. Then, in Step S520, the control chip 110 simulates the driving signal DS1 according to the clock signal CLK and the panel control data set in the control chip 110. Further, in Step S530, the control chip 110 drives the electronic paper display panel 120 with the clock signal CLK and the driving signal DS1. Thus, by following the steps described above, the control chip 110 outputs the clock signal CLK and the driving signal stably to drive the electronic paper display panel 120.

Besides, in this embodiment, implementations, details of the devices, and configuration relationship of the control chip and the electronic paper display panel shown in FIG. 5 can be understood sufficiently from the teaching, suggestion, and illustration of the previous embodiments. Thus, details thereof are not repeated hereinafter.

To conclude the above, the invention utilizes the control chip of the display panel to drive the electronic paper display apparatus. The clock signal is generated by the display controller in the control chip, and the driving signal for the electronic paper display panel is simulated according to the clock signal and the preset panel control data and directly outputted to the electronic paper display panel, so as to provide the driving signal without the processor in the control chip. Therefore, it is not required to additionally design a conversion chip integrated with timing control (TCON) for the electronic paper display panel. Interference with the timing of the driving signal provided by the processor can be eliminated to prevent the display quality of the electronic paper display panel from being affected. According to the invention, the timing of the clock signal and the panel control data can be set based on the requirement of use, such that the production cost of the electronic paper display apparatus is reduced and the electronic paper display apparatus can render favorable display quality and provide multiple operation functions.

It will be apparent to those skilled in the art that various modifications and variations can be made to the disclosed embodiments without departing from the scope or spirit of the invention. In view of the foregoing, it is intended that the invention covers modifications and variations of this disclosure provided that they fall within the scope of the following claims and their equivalents.

What is claimed is:

1. An electronic paper display apparatus, comprising:
an electronic paper display panel;
a control chip coupled to the electronic paper display panel to generate a clock signal;
a signal conversion circuit coupled to the control chip and the electronic paper display panel; and
a system module coupled to the control chip,
wherein the system module generates an operation signal according to a user setting and transmits the operation signal to the control chip,
wherein the control chip generates the clock signal according to the operation signal,
wherein the control chip comprises:
a liquid crystal display (LCD) controller, outputting the clock signal and outputting the panel control data according to the clock signal; and
a data transmission interface, coupled to the LCD controller to receive the panel control data and the clock signal and is configured to combine multiple pieces of digital information in the panel control data based on the clock signal so as to simulate a driving signal,
wherein the signal conversion circuit receives the driving signal and converts the driving signal to a panel driving signal that conforms to a signal transmission interface of the electronic paper display panel to drive the electronic paper display panel.

2. The electronic paper display apparatus according to claim 1, wherein the driving signal comprises a control signal and control data.

3. The electronic paper display apparatus according to claim 1, wherein the system module transmits the panel control data to the control chip.

4. The electronic paper display apparatus according to claim 3, further comprising:
a storage module coupled to the control chip to store the panel control data.

5. The electronic paper display apparatus according to claim 4, wherein the control chip comprises:
a processor coupled to the storage module and the system module to receive the panel control data and store the panel control data in the storage module.

6. The electronic paper display apparatus according to claim 4, wherein the control chip comprises:
an access circuit coupled to the storage module to read the panel control data.

7. A driving method of an electronic paper display apparatus for driving an electronic paper display panel with a control chip, a signal conversion circuit and a system module, the driving method comprising:
generating an operation signal by the system module according to a user setting;
transmitting an operation signal to the control chip by the system module;
generating a clock signal by the control chip according to the operation signal;
outputting the clock signal by a liquid crystal display (LCD) controller included in the control chip and outputting the panel control data according to the clock signal by the LCD controller included in the control chip;
receiving the panel control data and the clock signal by a data transmission interface included in the control chip;
combining multiple pieces of digital information in the panel control data based on the clock signal by the data transmission interface so as to simulate a driving signal;
converting the driving signal to a panel driving signal that conforms to a signal transmission interface of the electronic paper display panel by the signal conversion circuit; and
driving the electronic paper display panel with the clock signal and the panel driving signal.

8. The driving method according to claim 7, wherein the driving signal comprises a control signal and control data.

9. The driving method according to claim 7, further comprising:
transmitting the panel control data to the control chip by the system module.

10. The driving method according to claim 9, further comprising:
storing the panel control data by a storage module.

11. The driving method according to claim 10, wherein the control chip comprises a processor that receives the panel control data and stores the panel control data in the storage module.

12. The driving method according to claim 10, wherein the step of storing the panel control data by the storage module comprises:
receiving the panel control data and storing the panel control data in the storage module.

* * * * *